US005190328A

United States Patent [19]

Anderson

[11] Patent Number: 5,190,328

[45] Date of Patent: Mar. 2, 1993

[54] CARPET STRETCHING TOOL

[76] Inventor: Martin L. Anderson, Rte. 3, Box 60, Maple Lake, Minn. 55368

[21] Appl. No.: 734,622

[22] Filed: Jul. 23, 1991

[51] Int. Cl.[5] ..... A47G 27/04

[52] U.S. Cl. ..... 294/8.6; 403/108

[58] Field of Search ..... 294/8.6, , 19.1, 11, 294/62; 254/200, 212; 403/106, 108, 330; 410/145-149

[56] References Cited

U.S. PATENT DOCUMENTS

| | | | |
|---|---|---|---|
| 435,920 | 9/1890 | Cook | 254/212 |
| 2,882,642 | 4/1959 | Hill | 294/8.6 |
| 3,374,023 | 3/1968 | Hill et al. | 294/8.6 |
| 3,498,661 | 3/1970 | Graziano | 294/8.6 |
| 3,866,964 | 2/1975 | Prater | 294/8.6 |
| 4,119,338 | 10/1978 | Agcaoili | 294/8.6 |
| 5,027,674 | 7/1991 | Nolte et al. | 403/108 X |

*Primary Examiner*—Charles A. Marmor
*Assistant Examiner*—Joseph D. Pape
*Attorney, Agent, or Firm*—Haugen and Nikolai

[57] ABSTRACT

An improved carpet stretching tool of the knee-kicker type is disclosed in which outer and inner overlapping, slidably adjustable shank members connect and space a carpet gripping head having a spike plate and a plurality of cotton head sections and a knee plate. A locking system is provided in which the relative positions of the shank members can be adjustably fixed thereby fixing the height of the tool. The locking system employs several teeth integral with the outer shank member and adapted to mesh against mating protuberances integral with the inner shank member and a resilient member to urge the teeth against the protuberances. The teeth have a small amount of negative rake pitch matched by the protuberances to produce a positive wedging of matching inclined planes. The tool also has an improved and simplified carpet gripping cotton head system which employs an unique cotton head assembly and spike plate control system.

26 Claims, 5 Drawing Sheets

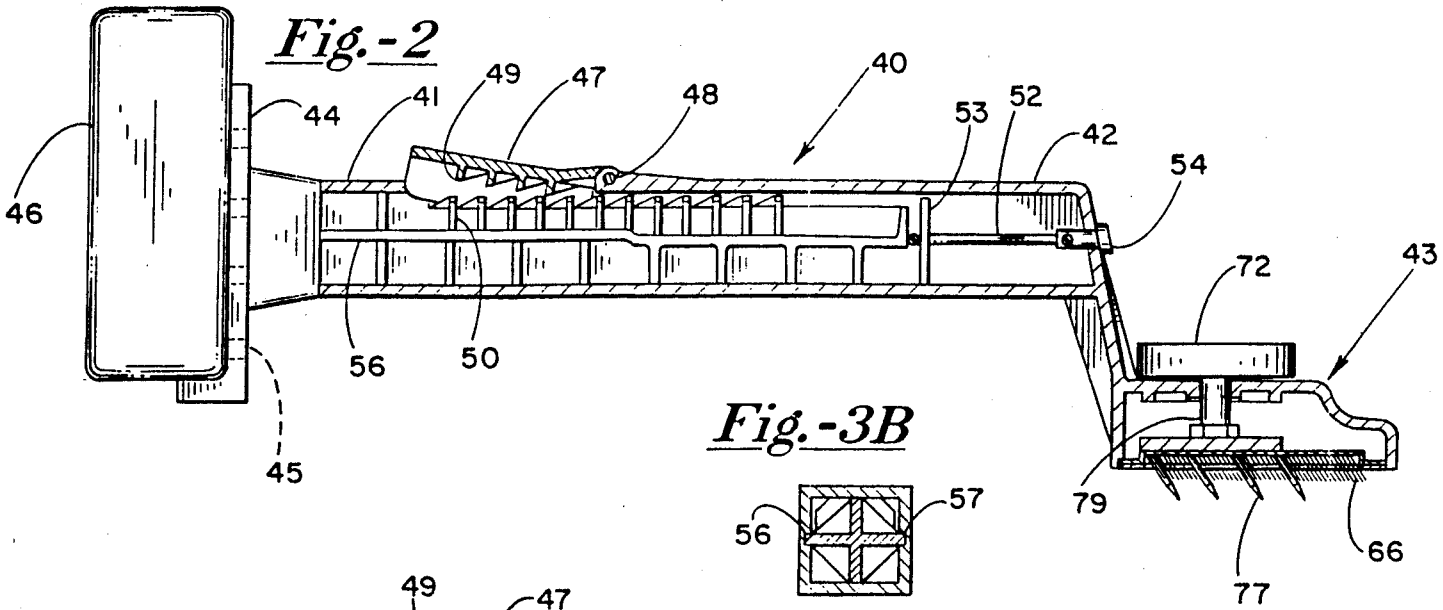
Fig.-2
Fig.-3B
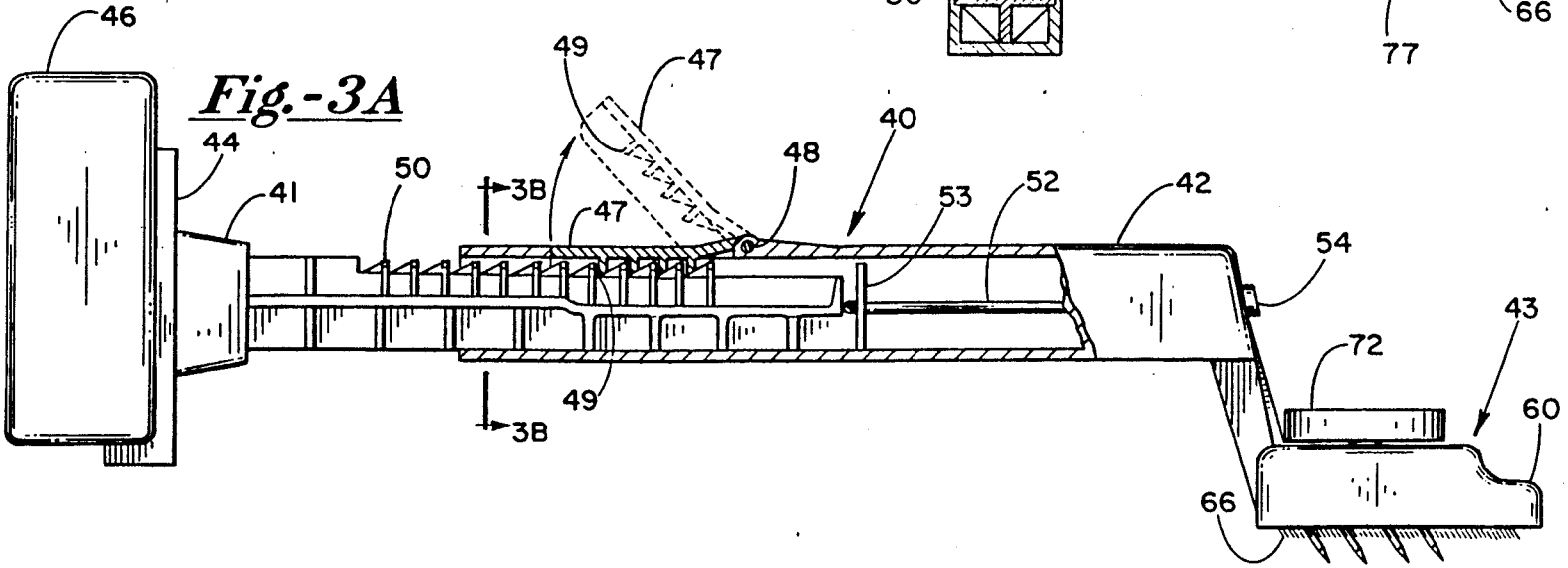
Fig.-3A 71A
64
67
78
69
66
65
63
61
78
73
73
80
77
68
62
78
76
70
75
70
74
71
60
75
79
72

CARPET STRETCHING TOOL

BACKGROUND OF THE INVENTION invention is directed generally to the subject of carpet stretching devices and, more particularly, involves an improved hand operated carpet stretching tool known as a "knee-kicker".

DESCRIPTION OF THE RELATED ART

The conventional hand operated carpet stretching tool consists of a sturdy metal frame connecting a relatively flat rectangular carpet addressing or gripping system. The system has a head member which includes one or more members carrying a relatively large number of closely spaced forward-directed metal pins or staples and known in the art as a "cotton head" which functions in conjunction with a plate carrying an array of spaced relatively heavy forward-directed spikes known as a spike plate. A heavy padded pusher plate at right angles to the carpet gripping system known as a "kick plate" is attached to the other end of the frame. The frame is designed so that the distance separating the kick plate from the carpet gripping system is made adjustable for the convenience of the installer.

The staple members of the cotton heads are relatively shorter and of much smaller diameter than the spike members. The height of the spike plate is adjustable so that the spikes can be extended or retracted with respect to the staple members much in the manner of the claws of a cat. The spike members protrude well beyond the pin or staple members when they are fully extended. The retractable spike plate allows them to be retracted below the level of the staples so that only the cotton head, i.e., the staples alone grip the carpet, if desired.

To better illustrate the state-of-the art at the time of the present invention, a typical existing device is illustrated in and will be described with reference to that FIG. 1. A device such as illustrated in FIG. 1 is further described in U.S. Patents to H. J. Hill (2,882,642) and H. J. Hill, et al. (3,740,023). The drawing of FIG. 1 depicts the device with parts cut away to reveal the internal adjustment and locking area. The floor covering stretching tool or "knee kicker", as they are generally known, is shown generally at 20 and includes slidably adjustable structurally interlocking shank members, including a lock block or outer body member 21 and an insert member 22; the lock block member 21 is larger and surrounds the member 22. The one end of member 21 is attached to a carpet gripping head or cotton head system 23 and is adapted to slide over the smaller insert member 22. The other end of member 22 is, in turn, fixed to a relatively heavy gauge, L-shaped knee plate or pusher plate 24. The knee plate 24 is further provided with a padded cushion member 25 which may be synthetic foam or other tough, resilient material. The cushion is prevented from rubbing on the floor during use of the device by the segment 24*a*.

The relative position of the members 21 and 22 is made adjustable to make the length of the tool therebetween extendable to accommodate a variety of users. The length of the tool is adjusted by means of a spring-biased, pivoting locking lever member 26 hinged and fixed to lock block member 21 by a pivot or hinge pin 27 journalled in a hinge and having a locking segment or tooth 28 and a tail section 29. The tail section further engages the member 21 at 30 by means of a compression spring 31 which urges the tail section outward at 32 and, thus, the locking segment 28 inward toward one of a plurality of longitudinally spaced recesses 33. Forward-directed spikes of the carpet gripper system are shown in an extended position at 34 protruding from the cotton head 23 and finer staples 35 are also illustrated. A rotatable knob 36 is used to extend and retract the spikes 34 by adjusting the height or vertical position of a spike plate in which the spikes are mounted (not shown).

In operation, the length of the stretching tool is adjusted by depressing the tail segment 29 of the member 26 to release the locking tooth 28 so that the members 21 and 22 can slide relative to each other. After the desired adjusted length is reached, the tail 29 is released and the locking tooth resets into the then adjacent one of the recesses 33. The device is operated by placing the head 23 horizontally on the floor such that it engages the carpet sought to be stretched near the edge thereof using the spikes and/or the pins. The operator holds the head 23 down engaging the carpet and repeatedly strikes the pad 25 with one knee thereby urging the edge of the carpet toward a tack strip or the like.

With prior devices designed in the manner of the device illustrated in FIG. 1, however, repeated striking of the pad by the user's knee produces undue strain and wear because the entire force is carried by the hinge pin 27. The pin soon becomes loose and ultimately fails. The single engaging or locking element 28 also tends to become loose fitting in the recesses 33 allowing free travel of the plate 24 with respect to the head 23 between kicks. The free travel, in turn, makes using the tool undesirable from the standpoint that the unevenness it produces in resistance when struck. This is known as "knee shock" and causes pain in the operator's knee and may even lead to chronic orthopedic knee, hip and/or back injury. In addition, with prior devices, the spike plate carrying the spike members is usually inadequately fixed within the cotton head housing thereby allowing unwanted (left/right) twisting of the member. This lack of positional stability can result in a twisting or torsional element to the force applied to the carpet which can result in damage to the carpet. The outer body member 21 and insert member 22 tend to be free to rotate to a certain degree relative to each other contributing additional general undesirable mechanical looseness to the device.

Certain other drawbacks limit the desirability of the device. For example, the relatively small size of the head system 23 is such that strong kicks can also result in damage to the carpet fabric. Because the length adjustment must be made from the underside of the device, it is difficult to adjust during use and the locking device may pop loose while the tool is being used. Other devices which are either quite complicated or lack positive locking mechanisms are shown in U.S. Pat. Nos. 3,498,661, 3,866,964 and 4,119,338. It is apparent that improvements in the design which would facilitate adjustment, mechanically tighten and allow the device to better withstand the rough treatment associated with use would be highly desirable.

SUMMARY OF THE INVENTION

The present invention presents an improved carpet stretching tool which overcomes many of the problems and shortcomings associated with prior devices. The carpet stretching tool of the invention combines a multi-tooth, top mounted adjustable, tight locking mechanism with an enlarged carpet engaging head in a manner which results in greatly reduced mechanical looseness. The structural parts may be ferrous or non-ferrous metal but are preferably made from high strength high impact polymeric materials which may contain fibers.

In the preferred embodiment, a relatively large single piece, multi-row, height-adjustable spike plate is used in conjunction with a cover plate and the cotton head pin pads containing the pins or staples are clamped in sandwich fashion between a cover plate and a relatively thick member having cutouts for the cotton head pin pads and a bottom retaining member in a three-piece sandwich construction. The cover plate uses a tab hold down arrangement in conjunction with a pair of screws to secure the cotton head above the spike plate. The single spike plate is adjustably mounted in the housing in a manner which includes positive retaining guides to prevent sideways rotational movement of the spike plate.

The preferred locking mechanism uses four wide teeth having a slight negative rake, possibly in the range of 2° to 10°, in combination with inclined receiving members and an improved resilient elastomeric retention or biasing arrangement which provide a positive and firm locking system involving the wedging action of two matching slightly inclined planes held in contact. The interlocking system is such that the force applied to the knee cushion is transmitted directly between the outer body and the insert members and not through the hinge pin.

The preferred embodiment also makes use of an improved knee cushion. The knee cushion may be made by in situ molding and curing of polyurethane or other suitable material.

BRIEF DESCRIPTION OF THE DRAWINGS

In the drawings:

FIG. 2 is a side elevational view of a hand operated carpet stretching tool in accordance with the invention with parts broken away to show certain internal mechanical details;

FIG. 3A is a view similar to that of FIG. 2 showing the operation of the locking mechanism;

FIG. 3B is a crossectional view along lines 3B—3B of FIG. 3A showing anti-rotation notch interlock details;

DETAILED DESCRIPTION

Figure 1:
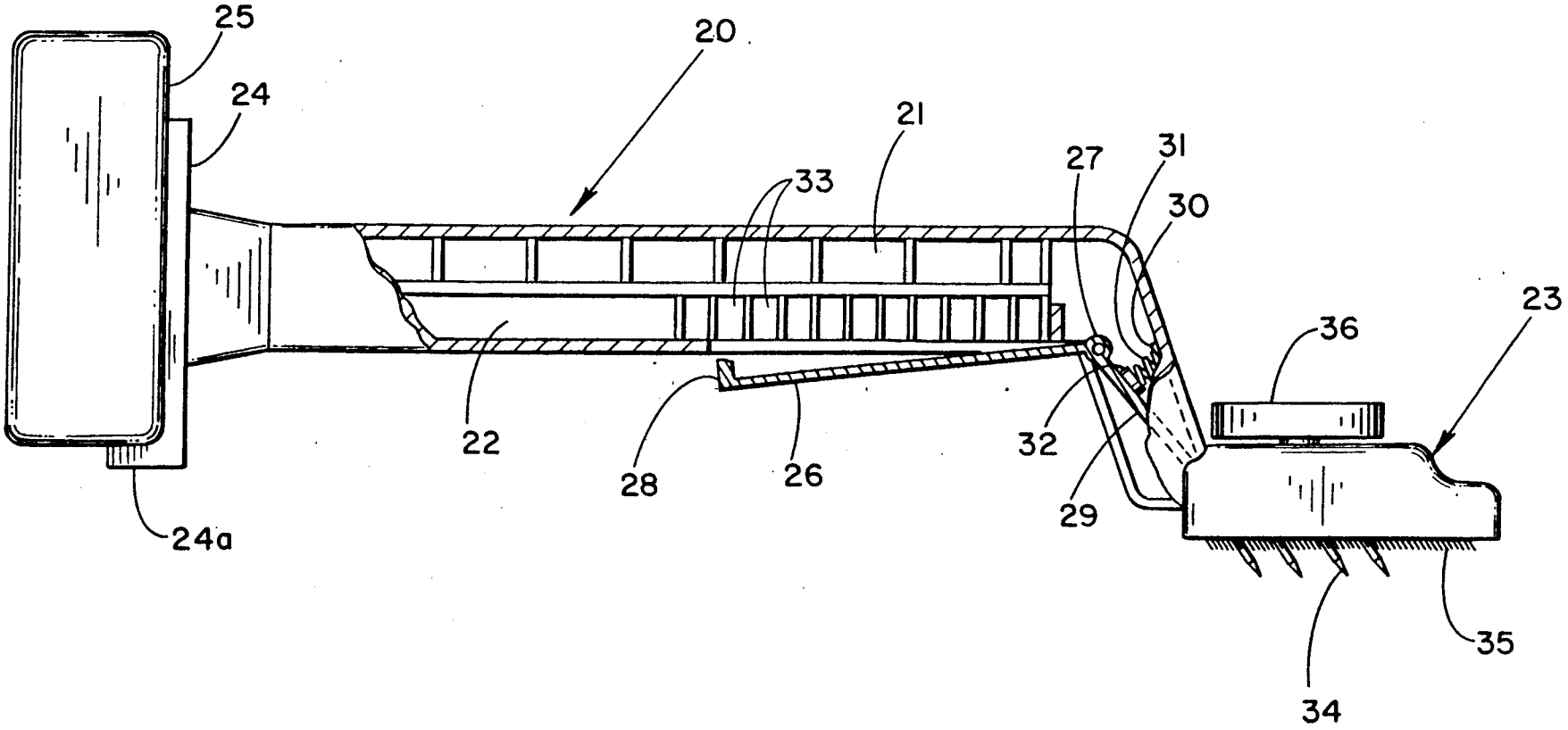
Fig. -1 (PRIOR ART)
FIG. 1 is a side elevational view with parts broken away to show some internal mechanical details of a typical prior art hand operated carpet stretching tool.
Figure 4A:
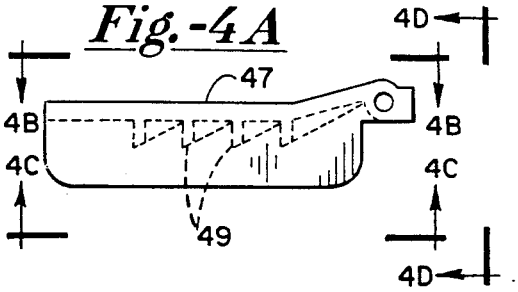
FIGS. 4A–4D depict further details of parts of the locking mechanism.
Figure 4C:
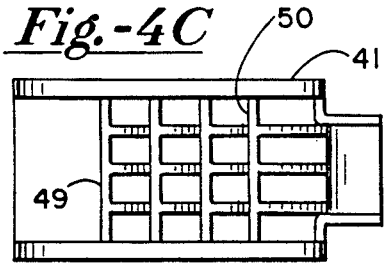
Figure 4B:
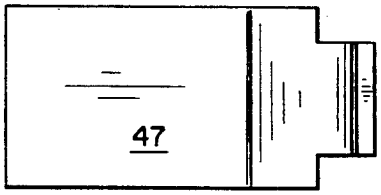
Figure 4D:
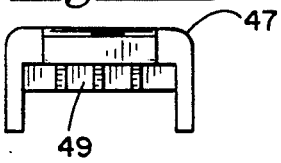
Figure 5A:
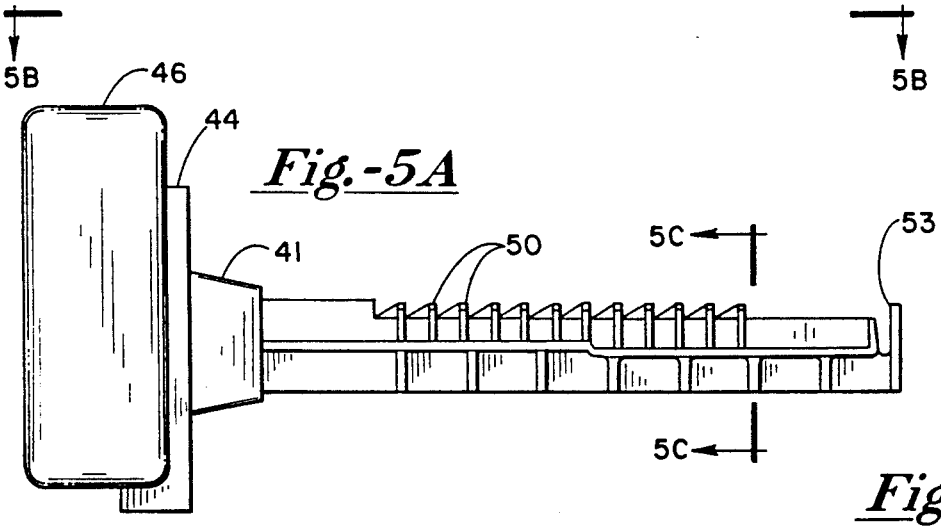
FIGS. 5A–5C show additional details of the tooth receiving insert associated with the adjustable locking mechanism of the invention.
Figure 5C:
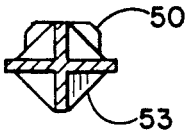
Figure 5B:
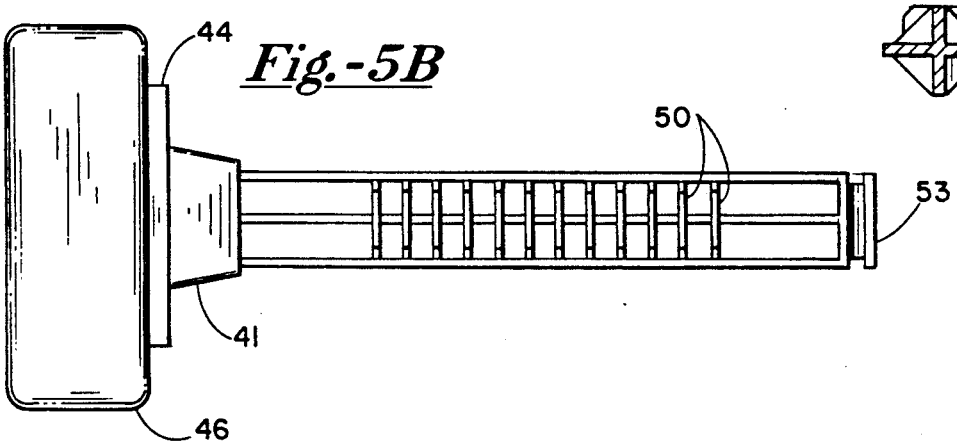
Figure 6:
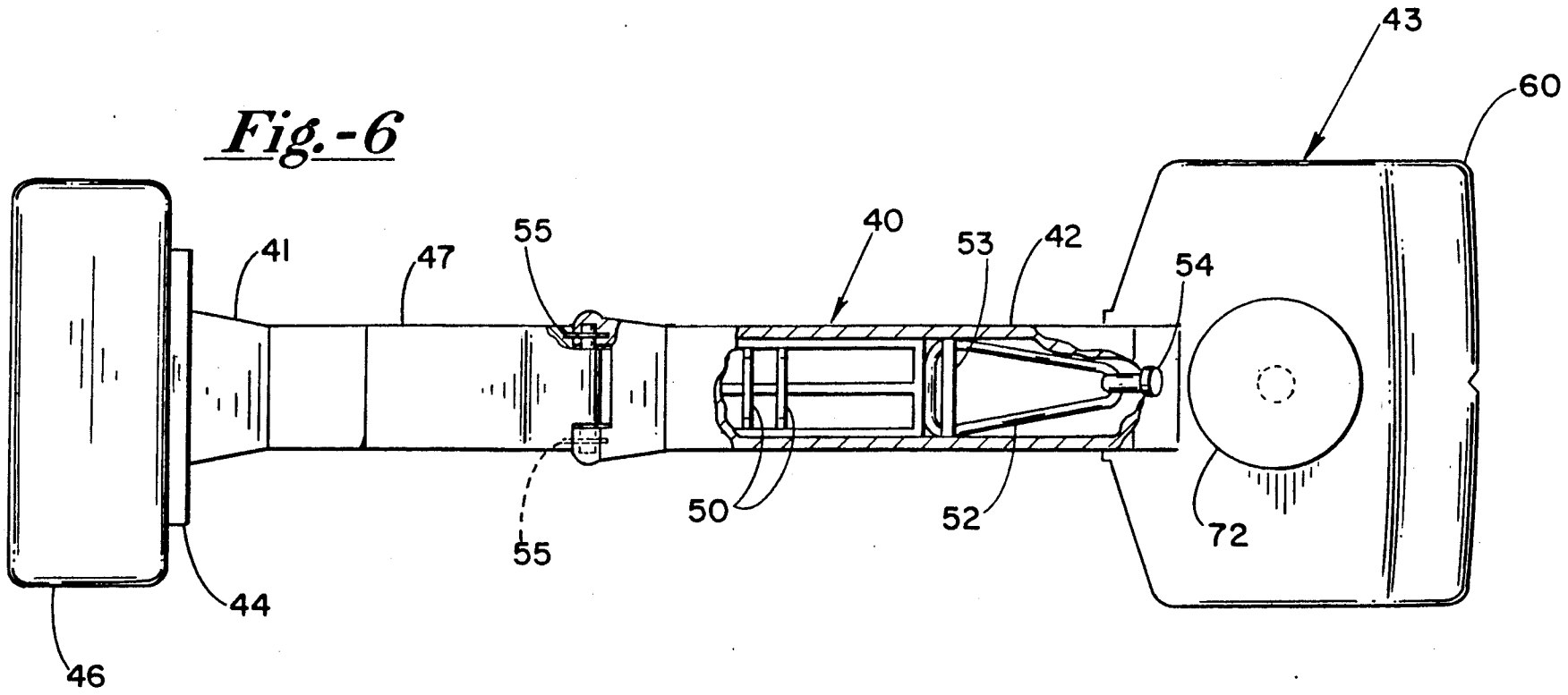
FIG. 6 is a top view of the carpet stretching tool of the invention with parts cut away to expose the resilient retaining means.

The improved carpet stretching tool of the present invention combines several novel features which overcome drawbacks or limitations found in prior devices to produce a distinctly superior, longer lasting device. These will become apparent as the invention is discussed in more detail, with particular reference to the several drawing figures.

FIG. 2 represents a side elevational view of a knee-kicker carpet stretching tool in accordance with the invention with parts broken away to illustrate certain mechanical details. The device is shown generally at 40 and includes structural shank members in the form of insert member 41 and lock block or outer body member 42, the member 42 being further attached to the carpet gripping head system 43 and the member 41 being fixed to pusher plate 44. The plate 44 is further provided with a padded knee cushion member 46 which, in some embodiments, may be made of urethane foam molded and cured in situ.

The members 41 and 42 slidably adjust and positively engage in an easily operable manner to vary the length of the tool between the carpet gripping head and the kick plate, as desired by the user. The length of the tool is adjusted by means of a spring-biased, pivoting locking system illustrated in detail by FIGS. 2, 3A, 3B, 4A–4D, 5A–5C and 6. A locking member 47, which pivots about a hinge pin 48, is provided with a plurality of broad teeth 49 which are designed to mesh against a series of similarly shaped, spaced protuberances 50 on the insert member 41.

The teeth 49 are provided with a slight negative incline or negative rake generally matched by the notch protuberances 50. The preferred range of the negative rake is about 2° to 10° in pitch with good success being achieved using 4°–6° of pitch. This allows teeth 49 to engage the notch members 50 more firmly upon receiving a knee blow through the kick plate 44. The intermeshing provides a wedging action between two matching inclined planes which urges the two shanks toward each other in tight engagement. Force is thus transferred directly between the members 41 and 42 eliminating strain on the hinge pin 48. In addition, the positive engagement of many teeth 49, normally four, provides a decidedly more rugged and positive locking arrangement than previous single-element locking systems.

The length is adjusted by pivoting the member 47 away from the recesses or lock block of insert 41, separating the teeth 49 from the notch members 50, as shown in phantom in FIG. 3A. Once the length is adjusted as desired, the member 47 is pivoted downward aided by torsion hinge springs 55 (FIG. 6), engaging the teeth 49 and the members 50. Tension exerted by a resilient member 52 (FIG. 6), which may be a rubber device such as a stretched O-ring or similar device fastened about a notch in member 41 behind 53 (FIGS. 5A and 5B) and a retaining pin means 54. The member 52 with closing hinge torsion springs 55 maintains tension between the teeth 49 and the members 50 which keeps the device locked in position until it is desired to again adjust the length of the system. The tension provided by the resilient device 52 also tends to make the device automatically collapse to its shortest form when the hinged member 47 is lifted to separate the teeth and lock block. This facilitates collapsing the tool for storage after use and can be overcome quite easily in adjusting the tool to increase its length.

The tension maintained on the system by the resilient device 52 further eliminates play or free longitudinal travel in the system, which has long been a problem to the user's knee. As seen in FIG. 3B, the inner member 41 is provided with rib members 56 which are designed to laterally interlock with recesses as at 57 in the outer member to eliminate twisting or relative rotation of the shank members. The composite system including the lock block, once adjusted, acts almost as though it were a single piece of material. In addition, by mounting the adjustment and locking mechanism on the upper side, adjustments are easier to make when the tool is being used.

While the members may be metal, high impact plastics which may be filled with fiberglass or carbon fibers are preferred as they appear to reduce weight and provide improved performance. The ability of such materials to flex slightly and then recover makes the transmission of force from the knee impact to the cotton head more efficient and easier on the user. One successful embodiment used shank and housing parts fabricated of polybutylene filled with about 20% by weight of glass fibers. In addition, the polymeric composition can readily be made self-lubricating by incorporating materials in the polymer premix which will reduce friction in the finished parts or slowly be exuded from the polymerized matrix during the life of the product. This precludes any possibility of unwanted stains being produced by oil dripping from tool parts or the like. The use of plastic materials rather than metal also reduces the weight of the tool and greatly reduces noise in conjunction with the adjusting and operating of the tool inasmuch as these parts make little noise when impacting each other.

An additional advantage associated with the improved resilient interlocking system of the carpet stretching tool of the invention is derived from the fact that, even as the tool wears out and the fit of the parts becomes less precise, the elastic nature of the assembly keeps the parts in relatively close abutment, thus precluding problems associated with a loosely fitting assembly. Thus, the free play between the parts of the assembly associated with prior devices as they wear does not occur.

Figure 7:
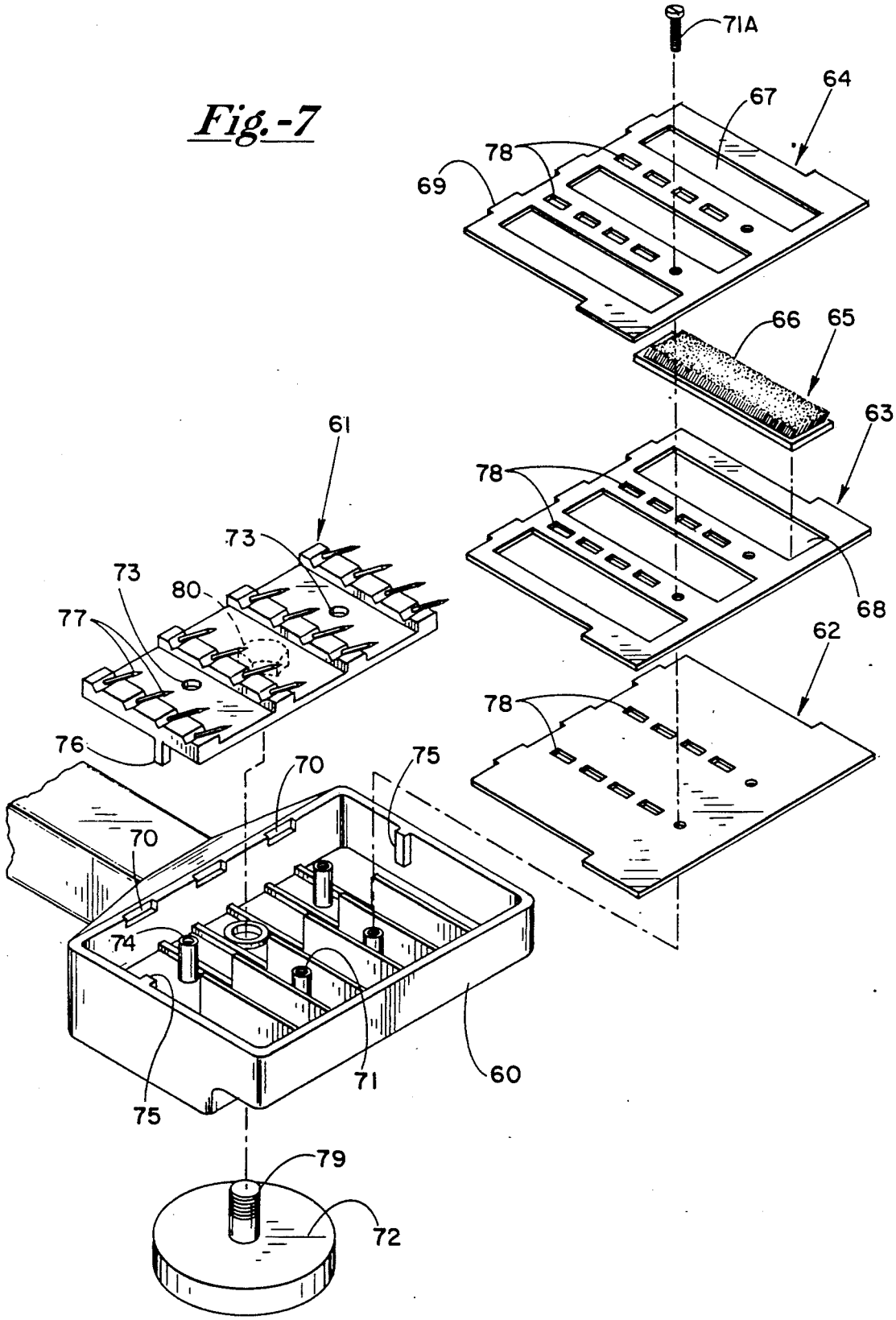
FIG. 7 is an exploded view of one carpet engaging head in accordance with the invention.

Details with respect to the carpet gripping head system will now be discussed. The system 43, as best shown in the exploded view of FIG. 7, includes a molded housing member 60 which encloses a spike plate 61, together with a three-piece cotton head assembly including backing plate 62, cotton head receiving plate 63 and cotton head retaining plate 64. The cotton head assembly further includes a plurality of cotton heads 65 containing carpet engaging staples or pins angularly disposed as shown at 66 (see FIGS. 2 and 3A), openings 67 in the retaining plate 64 are somewhat smaller than openings 68 in the cotton head pad receiving plate 63 so that the plurality of cotton heads 65 are peripherally retained by the plate 64 in a manner which allows the staples 66 to extend above the height of the plate 64 in a sandwich-like construction. The three-piece sandwich is retained in the housing 60 by engaging tabs 69, characteristic of the plate members 62–64, in the recesses 70 in the housing member 60. The sandwiched assembly is further held in place by a pair of screws as at 71A which extend through holes in the plate members 62, 63 and 64 and are threadably attached to extended socket members 71 in housing 60. The spike plate 61 is further provided with a pair of holes 73 adapted to ride up and down on a pair of guide members 74 integral with the housing member 60. In addition, tab member(s) as at 75 in the housing 60 are located to be juxtaposed corresponding tab(s) 76 in the spike plate 61 to operate in conjunction with the guide members 74 to inhibit rotation of the spike plate 61 within the housing member 60.

The spike plate 61 is provided with a plurality of spike members as at 77 which are fixed in and carried by the spike plate 61. The cotton head plate members 62–64 are further provided with a plurality of openings as at 78 to accommodate the spike members when they are extended to protrude beyond the cotton head. The spike plate can be raised and lowered using an adjustment knob 72 operated with threaded member 79 in conjunction with a nut 80 integral with the spike plate. This allows the spike plate to be positively adjusted up and down relative to the cover plate such that the spike members 77 may alternatively be extended and retracted. When the spike plate is retracted, the staple or pin members 66 protrude above the retaining plate 64 to provide the cotton head gripping action.

With respect to the cotton head, prior devices require each cotton head pad to be separately mounted by a pair of screws which greatly reduces the carpet holding or pin area and increases the complexity of assembly and disassembly of the system. Because only two small openings for screws are necessary with the assembly of the present invention, the effective or usable area of the staple or pin members 66 is greatly increased relative to the overall size of the head itself. It is further contemplated that the carpet addressing assembly be made large so that the total number of pins available to engage the carpet in the cotton head is greatly increased, thereby decreasing the chances of damaging or tearing carpet material being stretched or moved.

As stated above, the structural parts of the system are preferably molded from any one of a number of high impact plastic or polymer materials which are normally filled with carbon or glass fibers to increase their strength even further. The materials are lightweight and can withstand the constant abuse to which such tools are subjected under normal working conditions. Such materials reduce both the weight and the cost of the tools without decreasing the useful life expectancy. In addition, the resiliency of the plastic materials tends to make them easier on the user with respect to his reaction to repeated blows.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to without departing from the scope of the invention itself.

What is claimed is:

1. A hand operated carpet stretching tool comprising:

a carpet holding or gripping head system;

a padded knee plate;

outer and inner overlapping, slidably adjustable shank members connecting and spacing the carpet gripping head system and the knee plate;

adjustable locking means for fixing the relative positions of the outer and inner shank members thereby fixing the distance between the head system and the knee plate, the locking means including a plurality of serially spaced tooth members integral with the outer shank member adapted to mesh against a plurality of serial mating surfaces integral with the inner shank member which cooperate in a manner to rigidly withstand repeated impacts on the knee plate; and resilient means urging the teeth against the mating surfaces in a manner that urges the gripping head system and the knee plate toward each other.

2. The apparatus of claim 1 wherein the serial tooth members have a minor amount of negative incline which is matched by the mating surfaces which, when meshed, produces a positive wedging of matching inclined planes which cooperates with the resilient means to urge the shank members toward each other.

3. The apparatus of claim 2 wherein the negative incline is from about 2° to 10°.

4. The apparatus of claim 3 wherein the negative incline is from about 4° to 6°.

5. The apparatus of claim 2 wherein the number of serial tooth members is four.

6. The apparatus of claim 2 wherein the plurality of tooth members are pivotally mounted by a hinge system to the outer shank member.

7. The apparatus of claim 6 wherein the hinge system includes at least one resilient spring means urging the hinge system to close.

8. The apparatus of claim 2 wherein the resilient means is stretched between a stationary mounting fixed to the outer shank member and a tab on the inner shank member to thereby urge the outer and inner shank members to move past each other in a direction which urges the tooth members and mating surfaces to engage or wedge together more firmly.

9. The apparatus of claim 6 wherein the locking means is located on the upper side of the tool as employed.

10. The apparatus of claim 1 wherein the outer and inner shank members are further provided with a twist preventing means to prevent relative twisting of one shank member with respect to the other.

11. The apparatus of claim 10 wherein the twist preventing means is a tab and groove system.

12. The apparatus of claim 1 wherein the shank members are fabricated from an impact resistant polymer.

13. The apparatus of claim 8 wherein the shank members are fabricated from an impact resistant polymer.

14. The apparatus of claim 1 wherein the gripping head system has a housing member and wherein the shank members and gripping head housing member are fabricated from an impact resistant polymer material.

15. The apparatus of claim 1 wherein the gripping head system has a housing member and wherein the shank members and gripping head housing member are fabricated from a polybutylene polymer containing an amount of fiber material therein.

16. The apparatus of claim 15 wherein the fiber material is fiberglass.

17. The apparatus of claim 7 wherein the shank members are fabricated from a polybutylene polymer containing an amount of fiber material therein.

18. The apparatus of claim 17 wherein the fiber material is fiberglass.

19. A hand operated carpet stretching tool comprising:

a padded knee plate;

outer and inner overlapping, slidably adjustable shank members connecting and spacing the carpet gripping head system and the knee plate;

adjustable locking means for fixing the relative positions of the outer and inner shank members thereby fixing the distance between the head system and the knee plate, the locking means including a plurality of serial teeth members integral with the first shank member adapted to mesh against a plurality of serial mating surfaces integral with the inner shank member;

resilient means urging the teeth against the mating surfaces;

a carpet holding or gripping head system including a formed, generally hollow body housing member;

an adjustable spike plate carrying a plurality of spikes angled in a forward direction, and disposed in a predetermined pattern;

a cotton head system below the spike plate in the housing member, as disposed in the standard use configuration, the cotton head further comprising, a backing plate member;

a pad retaining plate juxtaposed the base plate member and comprising a plurality of openings for securing cotton head pads;

a plurality of cotton head pads, each having a patterned array of pin members protruding therefrom surrounded by pin-free margins, carried in a like number of recesses in the pad retaining plate;

a cotton head retaining plate overlaying the pad retaining plate and having openings therein to accommodate the cotton head pin arrays but overlapping the margins sufficiently to hold the pads in the recesses sandwiched between the retaining plate and the backing plate member;

wherein the base plate, pad receiving plate and pad retaining plate are provided with openings to accommodate the protrusion of the plurality of spikes; and means for adjusting the relative distance of the spike plate behind the cotton head to thereby control the amount of spike protrusion.

20. The apparatus of claim 19 wherein the cotton head system is fixed to the housing member by means of a plurality of spaced tab members adapted to engage recesses in the housing member and a pair of set screws.

21. The apparatus of claim 19 wherein the housing member further includes a plurality of spaced guide members substantially perpendicular to the plane of the spike plate, the spike plate further being provided with openings therethrough which coincide with the guide members such that the spike plate travels along the guide members during the adjustment thereof.

22. The apparatus of claim 19 wherein the housing member and spike plate are provided with anti-twist means to prevent skewing of the spike plate in the housing.

23. The apparatus of claim 22 wherein the anti-twist means further comprises at least one tab member on the housing an at least one tab member on the spike plate disposed in juxtaposed relation.

24. The apparatus of claim 19 wherein the shank members and gripping head housing member are fabricated from an impact resistant polymer material.

25. The apparatus of claim 19 wherein the shank members and gripping head housing member are fabricated from a polybutylene polymer containing an amount of fiber material therein.

26. The apparatus of claim 25 wherein the fiber material is fiberglass.

* * * * *